US007448434B2

(12) United States Patent
Turkington et al.

(10) Patent No.: US 7,448,434 B2
(45) Date of Patent: Nov. 11, 2008

(54) INVESTMENT CASTING

(75) Inventors: Michael K. Turkington, Manchester, CT (US); Delwyn E. Norton, Manchester, CT (US); Steven J. Bullied, Pomfret Center, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/473,865

(22) Filed: Jun. 22, 2006

(65) Prior Publication Data

US 2006/0237163 A1 Oct. 26, 2006

Related U.S. Application Data

(62) Division of application No. 10/840,706, filed on May 6, 2004, now Pat. No. 7,207,375.

(51) Int. Cl.
*B22C 9/04* (2006.01)

(52) U.S. Cl. ..... 164/516; 164/45; 164/235

(58) Field of Classification Search ..... 164/516, 164/376, 122.1, 235, 246, 45
See application file for complete search history.

(56) References Cited

U.S. PATENT DOCUMENTS

| | | | | |
|---|---|---|---|---|
| 1,825,051 | A * | 9/1931 | Clark | 425/179 |
| 2,201,131 | A * | 5/1940 | Jungersen | 164/7.1 |
| 5,072,771 | A * | 12/1991 | Prasad | 164/122.1 |
| 5,853,044 | A | 12/1998 | Wheaton et al. | |
| 5,921,309 | A * | 7/1999 | Nishida et al. | 164/35 |
| 7,207,375 | B2 * | 4/2007 | Turkington et al. | 164/516 |
| 2003/0047299 | A1 * | 3/2003 | Ma | 164/376 |

* cited by examiner

*Primary Examiner*—Kevin P Kerns
(74) *Attorney, Agent, or Firm*—Bachman & LaPointe, P.C.

(57) ABSTRACT

A wax or similar material may be molded to a base plate of an investment casting shelling fixture. The molding may provide for enhanced positioning of wax patterns or may provide a precise surface shape for the shell.

21 Claims, 6 Drawing Sheets

INVESTMENT CASTING

CROSS-REFERENCE TO RELATED APPLICATION

This is a divisional application of Ser. No. 10/840,706, filed May 6, 2004, and entitled INVESTMENT CASTING, now U.S. Pat. No. 7,207,375, the disclosure of which is incorporated by reference herein as if set forth at length.

BACKGROUND OF THE INVENTION

The invention relates to investment casting. More particularly, the invention relates to forming investment casting molds.

Investment casting is a commonly used technique for forming metallic components having complex geometries, especially hollow components, and is used in the fabrication of superalloy gas turbine engine components.

A well developed field exists regarding the investment casting of turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. The patterns are mounted to a shelling fixture. Prior to mounting, the fixture may be prepared to receive the patterns. For example, the fixture may be dipped in wax to at least coat a base plate of the fixture. The wax patterns may be placed atop the wax coating on the base plate and wax welded thereto.

In a shelling process, a ceramic shell is formed around one or more such patterns such as by spraying and/or dipping a ceramic coating material over the fixtured patterns. The wax may be removed such as by melting in an autoclave. The shell may be further processed such as by trimming and sanding of a base surface to flatten the base surface. The shell may be fired to harden the shell. This leaves a mold comprising the shell having one or more part-defining compartments which, in turn, contain the ceramic core(s) defining the cooling passages. The shell may be seeded to define the crystal orientation of the ultimate part and placed with its base surface atop a chill plate in a casting furnace. Molten alloy may then be introduced to the mold to cast the part(s). Upon cooling and solidifying of the alloy, the shell and core may be mechanically and/or chemically removed from the molded part(s). The part(s) can then be machined and treated in one or more stages.

Nevertheless, there remains room for improvement in the art.

SUMMARY OF THE INVENTION

Accordingly, one aspect of the invention involves a method for forming an investment casting shelling fixture component. A fixture plate is positioned relative to a die. A first material is molded between the die and at least a first surface portion of the fixture plate.

In various embodiments, the first surface portion may be along an upper face of the fixture plate. The first material may comprise, in major part, one or more waxes. The molding may provide a predominate essentially planar exposed surface for the first material. The molding may provide the exposed surface with means for locating patterns. The means may include flat elevated areas. The molding may leave a lower face of the plate substantially uncovered. A premolded second material may be secured atop the first material. The first and second materials may comprise, in major part, one or more waxes. The first and second materials may be essentially of similar composition.

Another aspect of the invention involves a method for forming an investment casting mold. A shelling fixture component is formed as described above. One or more patterns are secured to the fixture plate. The one or more patterns include a second material. One or more coating layers are applied over at least portions of the one or more patterns and at least a portion of the first material. The fixture plate is removed. The first material and the second material are substantially removed to leave a shell formed by the coating layers.

In various implementations, the fixture plate may be a first fixture plate and the method may include assembling a second fixture plate relative to the first fixture plate. The one or more patterns may be secured between the first and second fixture plates. The method may be used to fabricate a gas turbine engine airfoil element mold.

Another aspect of the invention involves a method for investment casting. An investment casting mold is formed as described above. Molten metal is introduced to the investment casting mold. The molten metal is permitted to solidify. The investment casting mold is destructively removed.

Another aspect of the invention involves a base plate for a shelling fixture. The base plate has opposite first and second faces. A number of holes extend between the first and second faces and are shaped other than as right cylindrical surfaces normal to the first face so as to provide back-locking. A wax material is located principally over at least a portion of the first face and extending into the holes.

In various implementations, the wax material may include means for aligning a number of patterns. The holes may have cross-sectional areas intermediate the first and second faces less than cross-sectional areas at the first and second faces. The first and second faces may have primary flat portions. There may be essentially no such wax material on the second face primary flat portion. The wax material may cover a majority of the first face primary portion.

Another aspect of the invention involves a die for forming a layer atop at least a first portion of a base plate of an investment casting shelling fixture. The die has one or more surfaces cooperating with at least a first face of the base plate to define a molding material-receiving space. The die has a passageway for introducing molding material to the molding material-receiving space.

In various implementations, the die may further include at least one means for registering the base plate. The one or more surfaces may include means for forming the molding material with pattern alignment features. The die may include means for accommodating a handle of the base plate during molding. The die may include a first half for receiving a lower face of the base plate and a second half for molding an upper surface of the molding material.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
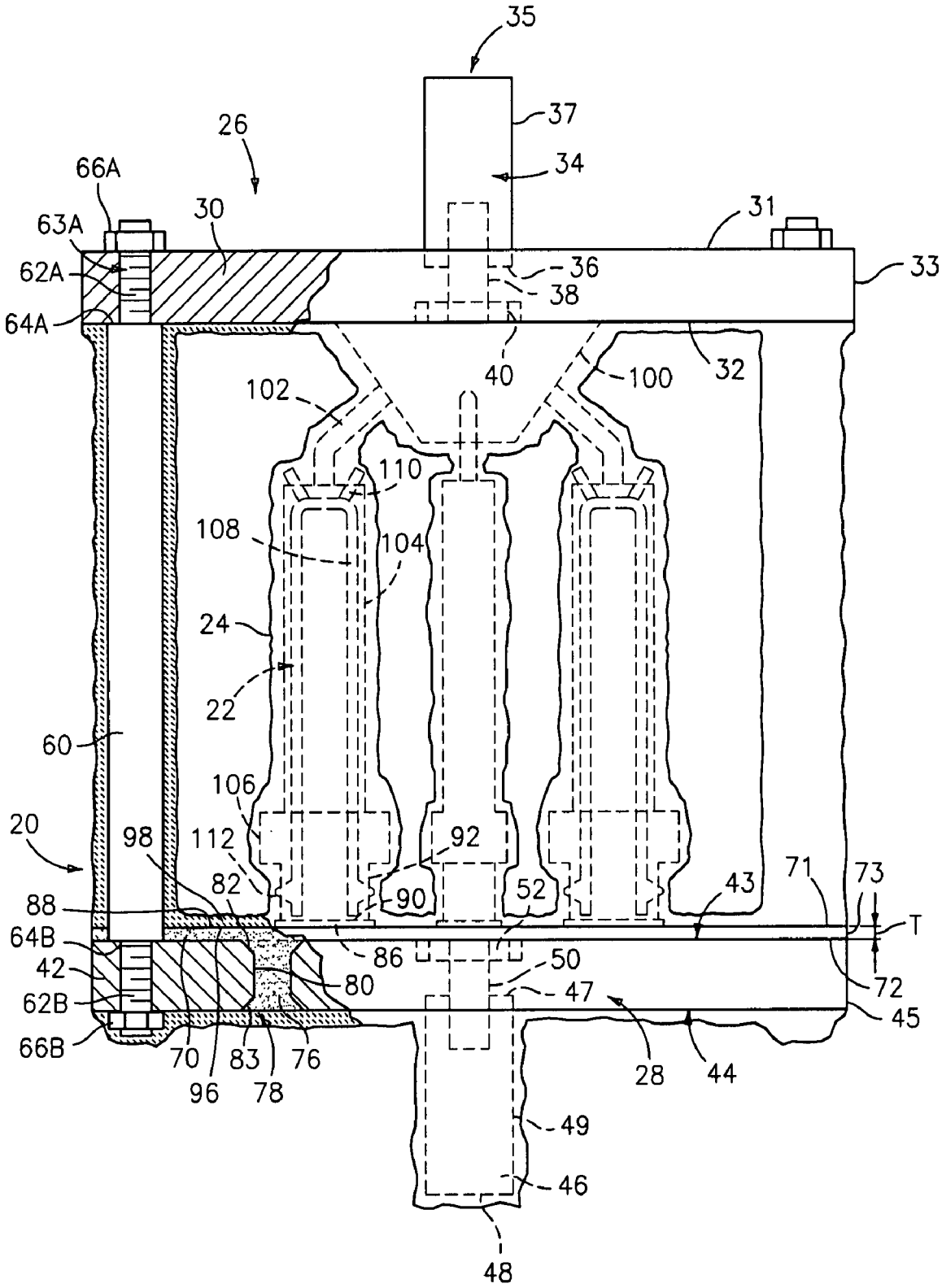
FIG. 1 is a partially cut-away view of a shelling fixture according to principles of the invention.

FIG. 1 shows a fixture 20 supporting a number of patterns 22 during the application of a shell coating 24 to the patterns. The fixture 20 includes top and bottom (base) plate assemblies 26 and 28, respectively. The top plate assembly 26 includes an exemplary circular plate 30 having top (upper) and bottom (lower/underside) surfaces 31 and 32 and a cylindrical lateral perimeter surface 33. The top plate assembly 26 further includes a cylindrical handle shaft 34 having upper and lower ends 35 and 36 and a lateral surface 37 and secured to the top plate 30 protruding from the upper surface 31 via a threaded stud 38 and nut 40.

In a similar fashion, the base plate assembly 28 includes a plate 42 having upper and lower surfaces 43 and 44 and a perimeter surface 45. A cylindrical base plate handle 46 has upper and lower ends 47 and 48 and a lateral surface 49 and is secured to the base plate 42 via a threaded stud 50 and nut 52 so as to depend from the lower surface 43.

To complete the basic mechanical fixture 20, a series of connecting rods 60 connect the top and base plate assemblies by spanning between the top plate lower surface 32 and base plate upper surface 43. In the exemplary embodiment, the rods 60 are of overall circular section and have upper and lower threaded end portions 62A and 62B extending through plate holes 63A and 63B and separated from a main body portion by an annular shoulder 64A and 64B abutting the associated end plate surface. Nuts 66A and 66B secure the rods to the associated end plates.

In the exemplary embodiment, a layer 70 of a sacrificial fugitive material is molded atop the base plate upper surface 43. The layer 70 generally has an exposed upper surface 71, a lower surface 72, and a perimeter surface 73. Depending from the lower surface or underside 72, a number of riveting portions 76 extend through apertures 78 in the base plate 42. The exemplary apertures are formed with a cross-sectional profile other than a right circular cylinder so as to engage the projections and retain the projections against extraction. The exemplary cross-sectional profile includes a central right circular cylindrical portion 80 and upper and lower beveled portions 82 and 83 extending from upper and lower ends of the central portion to the associated upper and lower surfaces 43 and 44. An infinite variety of alternative shapes may achieve similar interlocking. Similar interlocking may be achieved via blind holes rather than through-holes or via dovetail channels. Exemplary fugitive material is readily meltable or thermally decomposable. For example, natural or synthetic waxes or other hydrocarbon-based materials may be used.

The upper surface 71 includes a number of elevations 86 projecting above a principal planar surface portion 88. The exemplary elevations 86 are of generally rectangular platform and have a flat upper surface 90 dimensioned to accommodate a base 92 of the pattern 22 and facilitate alignment of the pattern when the pattern is assembled to the fixture. Alternate alignment means are possible. These may include slightly recessed areas and wall structures for accommodating the base portion of the pattern. Such alignment means may also help laterally retain the pattern in position while the pattern is secured (e.g., via wax welding). Aside the patterns, the upper surface 71 provides a form for the formation of a base surface or underside 96 of a base portion 98 of the coating 24.

A wax pour cone element 100 depends from the underside 32 of the top plate 30. Feeders 102 extend between the cone 100 and patterns 22 for forming feed passageways in the mold between a mold pour cone and the part-defining mold cavity provided when the wax from the pattern is removed.

The exemplary pattern 22 is shown as a turbine engine blade having an airfoil 104 and a root 106. In the exemplary embodiment, a core (e.g., a ceramic core) 108 extends within the wax of the pattern and has ears 110 and 112 protruding from the wax into the coating 24. Upon ultimate wax removal, the core 108 will be left within the cavity in the coating held in place via the ears.

Figure 2:
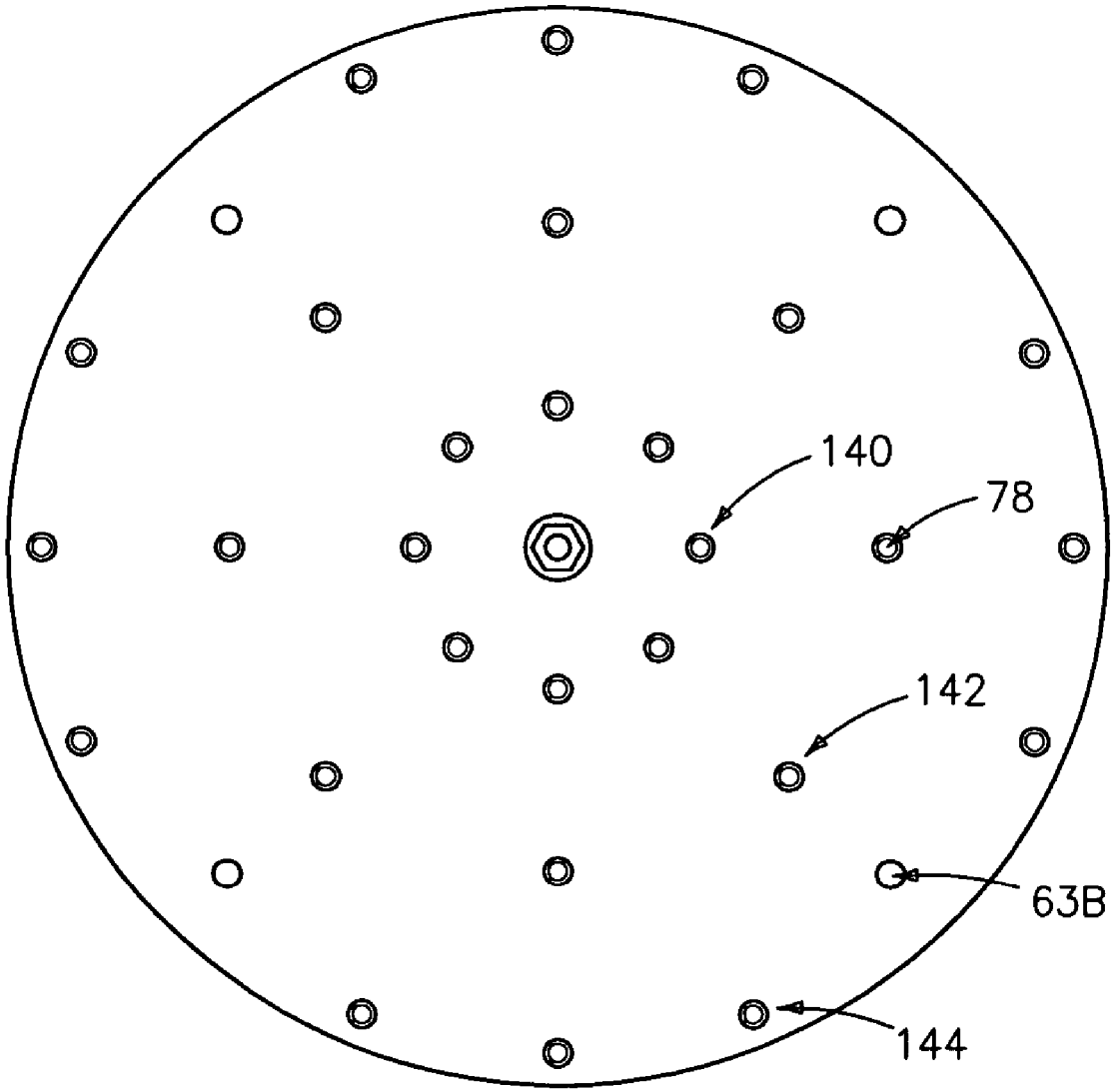
FIG. 2 is a top view of a base plate of the fixture of FIG. 1.

FIG. 2 shows details of the exemplary base plate assembly. The exemplary holes 78 are arranged in three circular rings: an inboard ring 140 of eight evenly spaced holes, an intermediate ring 142 of eight evenly spaced holes, and a perimeter ring 144 of four groups of three evenly spaced holes. Roughly between each of the four groups is one of the rod mounting holes 63B. Exemplary base plate diameter is between 10 cm and 1 m, more narrowly, 30-70 cm. Exemplary base plate thickness is 1-3 cm. Exemplary base plate material is aluminum alloy or stainless steel.

Figure 3:
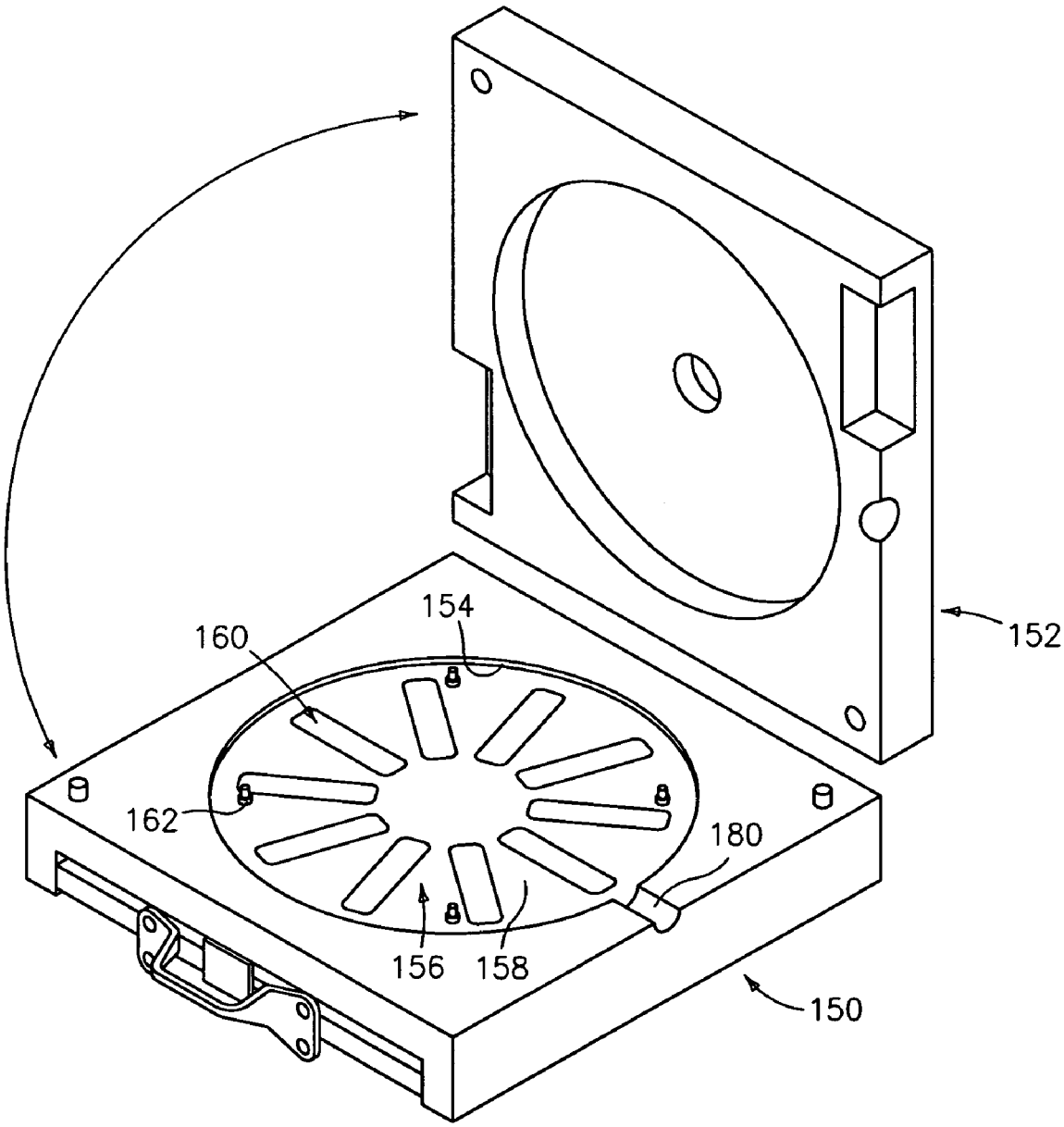
FIG. 3 is a view of a die for molding a wax layer atop the base plate of FIG. 2.
Figure 4:
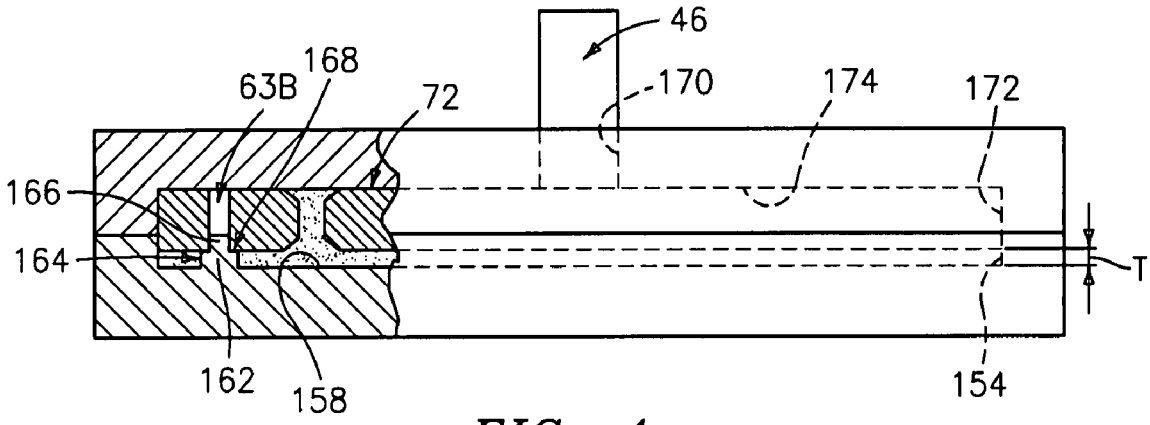
FIG. 4 is a partial cut-away view of the die of FIG. 3 during molding.

FIG. 3 shows details of a die for molding the layer 70. The die has first and second halves 150 and 152. In the exemplary embodiment, the layer 70 is molded to the base plate 42 with the base plate in an upside down orientation. With reference to this orientation, the first die half 150 is used as a lower die half. The die half 150 has a compartment with a cylindrical perimeter surface 154 and an upper/base surface 156. The base surface 156 has a principal flat portion 158 for molding the layer flat portion 88 and an array of recesses 160 for molding the elevated areas 86. Four bosses 162 extend upward above the surface portion 158 and are aligned with the holes 63B. FIG. 4 shows the bosses 162 having a wide proximal portion 164 and a narrow distal portion 166 with a shoulder 168 therebetween. The distal portion 166 is accommodated in the associated hole 63B with the shoulder 168 abutting the surrounding base plate top surface to hold the top surface spaced apart from the die surface portion 158 by the desired thickness T of the wax layer along the portion 88. FIG. 4 further shows the upper die half 152 as having a central aperture 170 for accommodating the handle 46. The upper die half 152 has a compartment with a circular cylindrical lateral wall portion 172 and a base portion 174. In the exemplary embodiment, the surface portions 154 and 172 combined to closely accommodate the perimeter surface 73 and prevent substantial wax infiltration around such surface, leaving the perimeter surface 45 largely free of wax. Similarly, the base surface portion 174 of the upper die half 152 closely accommodates and advantageously contacts the base plate underside 44 so as to allow filling of the apertures 78 without substantial wax accumulation on a remaining intact portion of the underside 72. The boss proximal portions 164 form associated circular holes in the layer 70 aligned with the holes 63B to accommodate the end portions of the associated rod main body portions. A channel 180 (FIG. 3) may be provided in one or both die halves for the introduction of wax.

Figure 5:
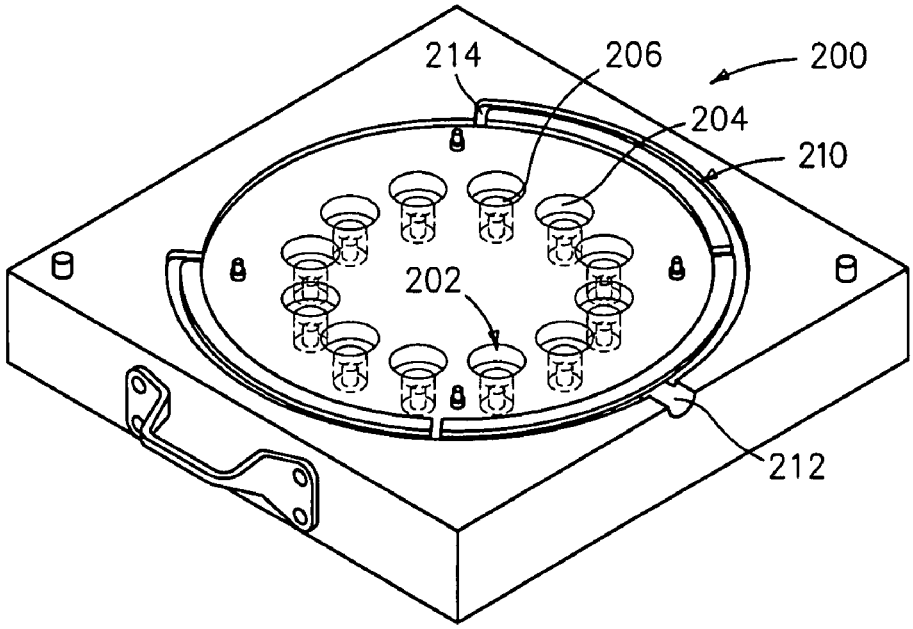
FIG. 5 is a view of an alternate die half.

FIG. 5 shows an alternate lower die half 200 containing a ring of stepped deep recesses 202 in its compartment. These recesses 202 form more substantial pattern locating features as is described in further detail below. The exemplary recesses have a broad circular cylindrical proximal portion 204 and a narrower distal annular portion 206. To provide the enhanced volume of wax required, a wax manifold 210 partially surrounds the cavity and has an inlet 212 for receiving wax and a number of outlets 214 for delivering wax to the cavity.

Figure 6:
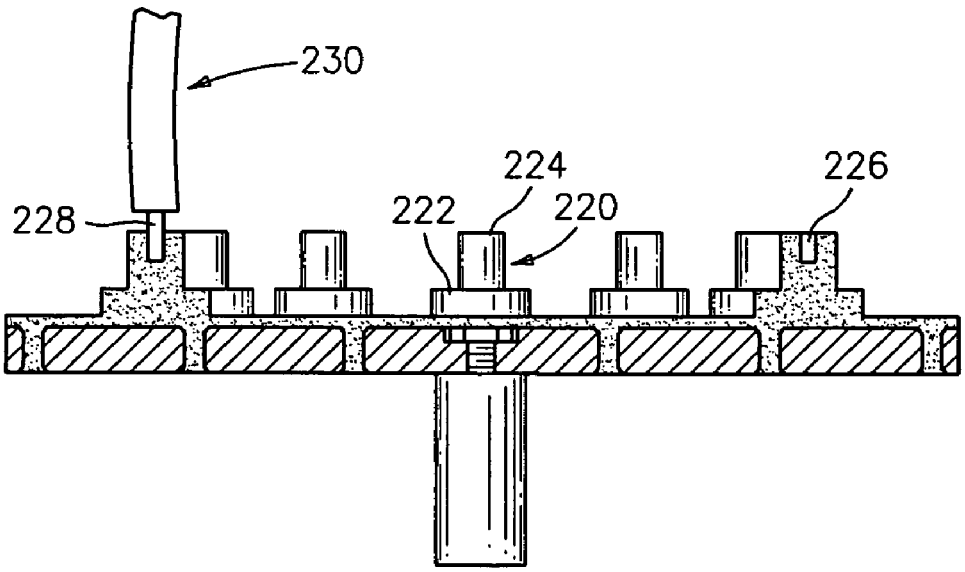
FIG. 6 is a sectional view of a layer molded by the die half of FIG. 5.

FIG. 6 shows further details of the exemplary alternate pattern locating features 220. Each feature 220 has a large diameter base portion 222 and a narrower annular sleeve-like portion 224 extending upward therefrom. A compartment 226 in the sleeve-like portion 224 may receive a projection 228 from a pattern 230. The exemplary pattern 230 forms cavity in the resulting shell for casting a combustor panel. The feature 220 may form a volume in the resulting shell for receiving a seed to establish a crystallographic orientation of the ultimate cast panel.

Figure 7:
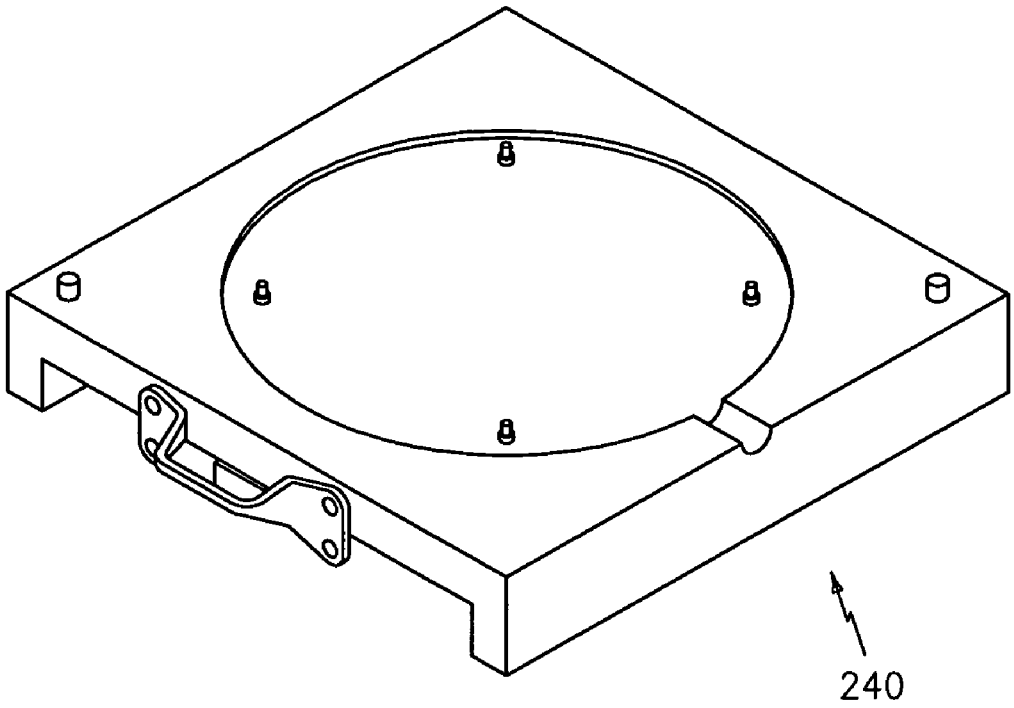
FIG. 7 is a view of a second alternate die half.

FIG. 7 shows a second alternate lower die half 240 for molding a wax layer with an essentially completely planar exposed upper surface.

Figure 8:
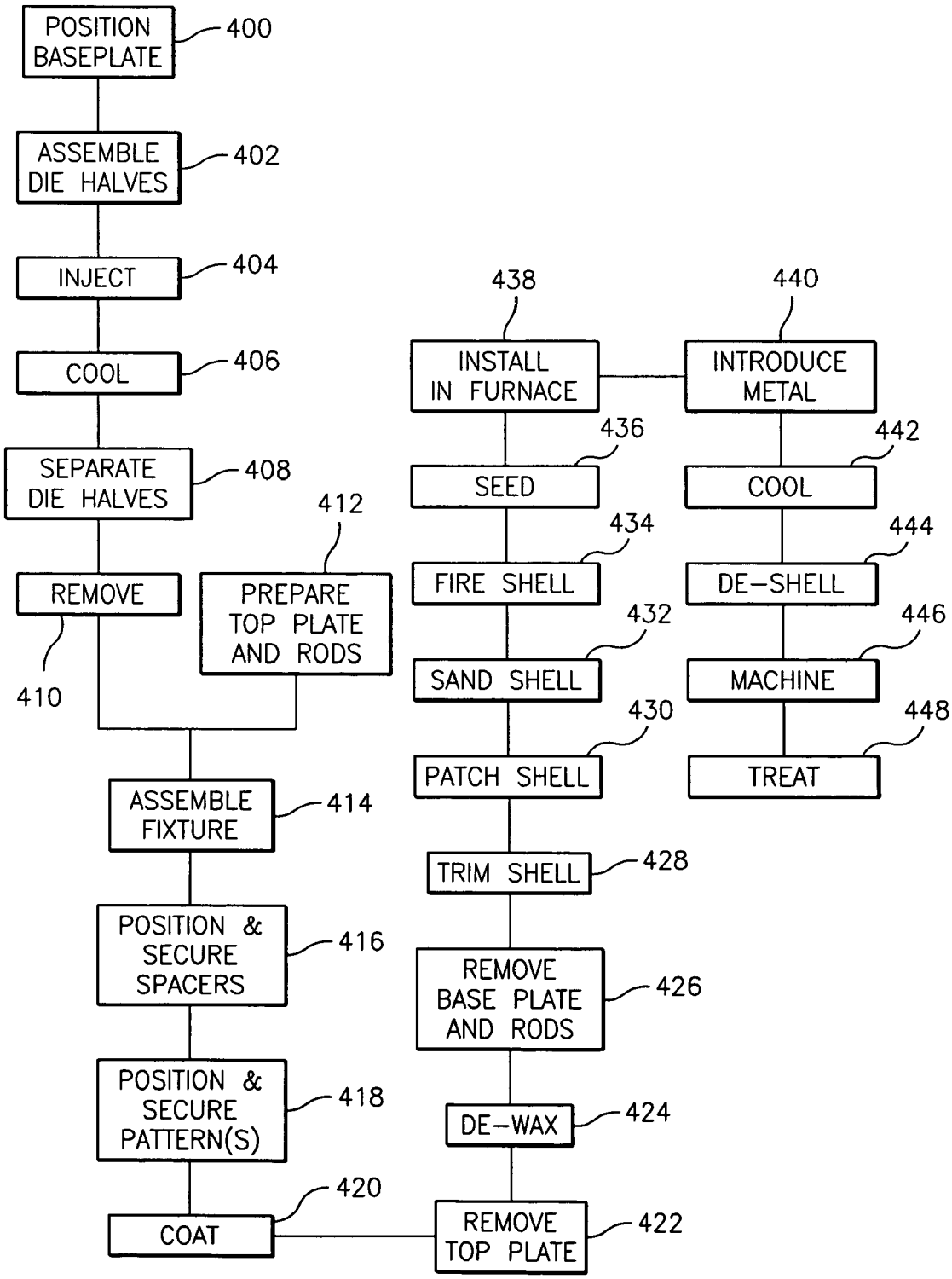
FIG. 8 is a flowchart of a process for investment casting according to principles of the invention.

FIG. 8 shows an exemplary sequence of steps for using the fixtures in an investment casting process. The base plate is positioned 400 in the lower die half and the die halves are assembled 402. The wax or like material is injected 404 to form the layer 70. The wax is allowed to cool 406. The die halves are separated 408 and the base plate removed 410 with the layer 70 attached.

In parallel with the preparation of the base plate, the top plate and rods may be prepared 412. This preparation may involve securing the pour cone to the top plate and applying, to remaining surface portions of the top plate and rods, a thin layer of wax or other release agent to ultimately facilitate release from the coating. The rods may be preassembled to the top plate or this may occur in the subsequent fixture assembly stage 414 in which the rods are secured to the base plate. If not premolded as part of the layer 70, wax spacers (e.g., similar to features 220) or other pattern locating features may be secured 416 to the layer such as via wax welding. The patterns may then be positioned and secured 418 (e.g., via wax welding along with the feeders and any additional wax components). The coating may be applied 420 in one or more steps involving combinations of wet or dry dipping and wet or dry spraying. During coating, wipers (not shown) keep the top and base plate perimeter surfaces 33 and 45 clean. This facilitates subsequent disengagement of the top and base plates from the shell. There may be drying steps between the coating steps.

After a final drying, the top plate may be removed 422. The wax may be removed via a dewax process 424 such as in a steam autoclave. After the dewax process, the base plate and rods may be removed 426 as a unit and the rods may be disassembled from the base plate for reuse of both. The shell may then be trimmed 428 (e.g., to remove a base peripheral portion including portions which had covered the rods and to trim an upper portion around the pour cone). If there are minor defects in the shell they may be patched 430. The shell underside may be sanded 432. Given the high initial planarity afforded by the relatively precise injected upper surface 71, such sanding may be relatively minor and may potentially be omitted altogether. This is in contrast with dipped base plate wax layers which may require extensive sanding to planarize the pattern underside. The shell may be fired 434 to strengthen the shell and may be seeded 436 if required to form a predetermined crystallographic orientation. The shell may then be installed 438 in the casting furnace and the molten metal introduced 440. After cooling 442 of the metal, the metal part(s) may be deshelled 444. Machining 446 may separate the parts from each other, remove additional surplus material, and provide desired external and internal part profiles. Post machining treatments 448 may include heat or chemical treatments, coatings, or the like.

One or more embodiments of the present invention have been described. Nevertheless, it will be understood that various modifications may be made without departing from the spirit and scope of the invention. For example, if the foregoing teachings are applied to existing manufacturing equipment or in the manufacture of existing components, details of the equipment or components may influence details of any particular implementation. Accordingly, other embodiments are within the scope of the following claims.

What is claimed is:

1. A combination comprising:

a base plate for a shelling fixture comprising:

a first face;

a second face opposite the first face;

a plurality of holes extending between the first and second faces and shaped other than as right cylindrical surfaces normal to the first face; and a wax material principally over at least a portion of the first face and extending into the plurality of holes; and a die for forming a layer atop at least a first portion of the base plate comprising:

one or more surfaces cooperating with at least the first face of the base plate to define a space molding the wax material; and a passageway positioned for introducing the wax material to the space.

2. The combination of claim 1 further comprising:

at least one means for registering the base plate.

3. The combination of claim 1 wherein:

the one or more surfaces include means for forming the wax material with pattern alignment features.

4. The combination of claim 1 further comprising:

means for accommodating a handle of the base plate during molding.

5. The combination of claim 4 comprising:

a first half for receiving the second face of the base plate; and a second half for molding an upper surface of the wax material.

6. A base plate for a shelling fixture comprising:

a first face;

a second face opposite the first face;

a plurality of holes extending between the first and second faces and shaped other than as right cylindrical surfaces normal to the first face; and a wax material principally over at least a portion of the first face and extending into the plurality of holes.

7. The base plate of claim 6 wherein:

the holes are through-holes.

8. The base plate of claim 6 wherein:

said wax material includes means for aligning a plurality of patterns.

9. The base plate of claim 6 wherein:

said wax material includes protruding bosses having central recesses.

10. The base plate of claim 6 wherein:

said wax material includes recesses below a principal flat surface.

11. The base plate of claim 6 wherein:

said plurality of holes have cross-sectional areas intermediate the first and second faces less than cross-sectional areas at the first and second faces.

12. The base plate of claim 6 wherein:

said first and second faces have primary flat portions;

there is essentially no said wax material on the second face primary flat portion; and said wax material covers a majority of the first face primary portion.

13. The base plate of claim 6 further comprising:

a handle shaft protruding from an underside of the second face.

14. The base plate of claim 6 in combination with:

a top plate; and a plurality of members connecting the base plate to the top plate.

15. The combination of claim 14 farther comprising:

one or more patterns secured between the base plate and the top plate.

16. The combination of claim 14 wherein:

the one or more patterns each comprise a wax body and a core.

17. The combination of claim 14 farther comprising:

a handle shaft protruding from an upper surface of the top plate.

18. A base plate for a shelling fixture comprising:

a first face;

a second face opposite the first face;

means for retaining a molded wax material to the first face;

said molded wax material atop the first face;

means for engaging connecting rods for connecting to a top plate; and a handle protruding from the second face.

19. An investment casting shelling fixture comprising:

a substrate;

a top member; and a plurality of members connecting the substrate to the top member; and a sacrificial material molded to the substrate and having surface portions for directly or indirectly engaging one or more investment casting patterns.

20. The fixture of claim 19 wherein:

the sacrificial material is hydrocarbon-based;

the substrate is reusable; and the surface portions include means for directly or indirectly aligning said one or more patterns.

21. The fixture of claim 19 wherein:

the sacrificial material is a wax.

* * * * *

UNITED STATES PATENT AND TRADEMARK OFFICE

CERTIFICATE OF CORRECTION

PATENT NO. : 7,448,434 B2
APPLICATION NO. : 11/473865
DATED : November 11, 2008
INVENTOR(S) : Michael K. Turkington et al.

It is certified that error appears in the above-identified patent and that said Letters Patent is hereby corrected as shown below:

In column 7, claim 15, line 10, delete "farther" and insert --further--.

In column 7, claim 17, line 16, delete "farther" and insert --further--.

Signed and Sealed this

Eighth Day of December, 2009

David J. Kappos

David J. Kappos
*Director of the United States Patent and Trademark Office*